United States Patent [19]

Guttinger

[11] 4,108,213

[45] Aug. 22, 1978

[54] METHOD AND APPARATUS FOR A WEAVING MACHINE FOR FORMING A FABRIC SELVEDGE

[75] Inventor: Peter Guttinger, Tann-Rüti, Switzerland

[73] Assignee: Ruti Machinery Works Ltd, Ruti, Switzerland

[21] Appl. No.: 779,780

[22] Filed: Mar. 21, 1977

[30] Foreign Application Priority Data

Mar. 25, 1976 [CH] Switzerland ..... 3728/76

[51] Int. Cl.[2] ..... D03D 47/40

[52] U.S. Cl. ..... 139/54

[58] Field of Search ..... 139/54, 430

[56] References Cited

U.S. PATENT DOCUMENTS

| | | | |
|---|---|---|---|
| 2,802,488 | 8/1957 | Opletal et al. | 139/54 |
| 3,981,331 | 9/1976 | Camprubi | 139/54 |

FOREIGN PATENT DOCUMENTS

| | | | |
|---|---|---|---|
| 2,282,007 | 3/1976 | France | 139/54 |

*Primary Examiner*—Henry S. Jaudon
*Attorney, Agent, or Firm*—Donald D. Denton

[57] ABSTRACT

A method and apparatus for producing a fabric selvedge in which two pairs of selvedge threads are looped into one another.

15 Claims, 9 Drawing Figures

METHOD AND APPARATUS FOR A WEAVING MACHINE FOR FORMING A FABRIC SELVEDGE

BACKGROUND OF THE INVENTION

The invention relates to a method and apparatus for producing a fabric selvedge with two crossing threads and two noncrossing threads.

In a known method of this kind, both the crossing threads and also the noncrossing threads are guided in eyelets which are arranged substantially vertically below one another. The selvedge is formed by moving the noncrossing threads in one direction and the crossing threads in the other direction in order to form a shed, and passing the crossing threads through the space between the noncrossing threads in opposite, crossing movements. As practical experience has shown, the leno selvedge formed in this way is of only relatively low strength.

The closest prior art known to applicant in connection with this application is U.S. Pat. No. 2,918,945.

SUMMARY OF THE INVENTION

The invention provides a method and apparatus that considerably improves the strength of leno selvedges. In accordance with the invention, the method is characterized in that a crossing thread and a noncrossing thread in each case are associated with one another as a pair of selvedge threads and guided in substantially adjacent arranged eyelets, and that the selvedge is formed by the cyclic repeating of the following method steps:

(a) Shed forming movement of the one pair of selvedge threads in one direction and the other pair of selvedge threads in the other direction, subsequent swinging of each crossing thread from one side of its associated noncrossing thread to the other side, and insertion of a weft thread; and (b) Shed forming movement of the one pair of selvedge threads in the other direction and the other pair of selvedge threads in the one direction and subsequent insertion of a weft thread; the crossing threads so guided and swung that at each shed forming movement following the swinging of the crossing threads, the crossing thread of each pair of selvedge threads crosses with the noncrossing thread of the other pair of selvedge threads.

In the method provided by the present invention, in each case a crossing thread and a noncrossing thread forming a pair of selvedge threads carry out the same shed forming movement. After each two shed forming movements, the two pairs of selvedge threads are looped into one another to produce a leno selvedge having an extremely high strength and the free weft thread ends projecting from the selvedge can be kept substantially shorter than in the case of known selvedges of this kind.

The invention is also concerned with an apparatus having an arrangement in a weaving machine for carrying out the aforesaid method, with holding means for the guide eyelets of the crossing and noncrossing threads and with first and second driving means which are coupled with these holding means, the first driving means being provided for the shed forming movements of all the holding means, and the second driving means for the swinging of the holding means supporting the guide eyelets of the crossing threads.

The apparatus according to the invention is characterized in that the first and second driving means are so controlled that the swinging of the holding means for the guide eyelets of the crossing threads is always effected after each second shed forming movement.

BRIEF DESCRIPTION OF THE DRAWINGS

These and other objects will become apparent from the constructional examples and the drawings in which.

Figure 1:
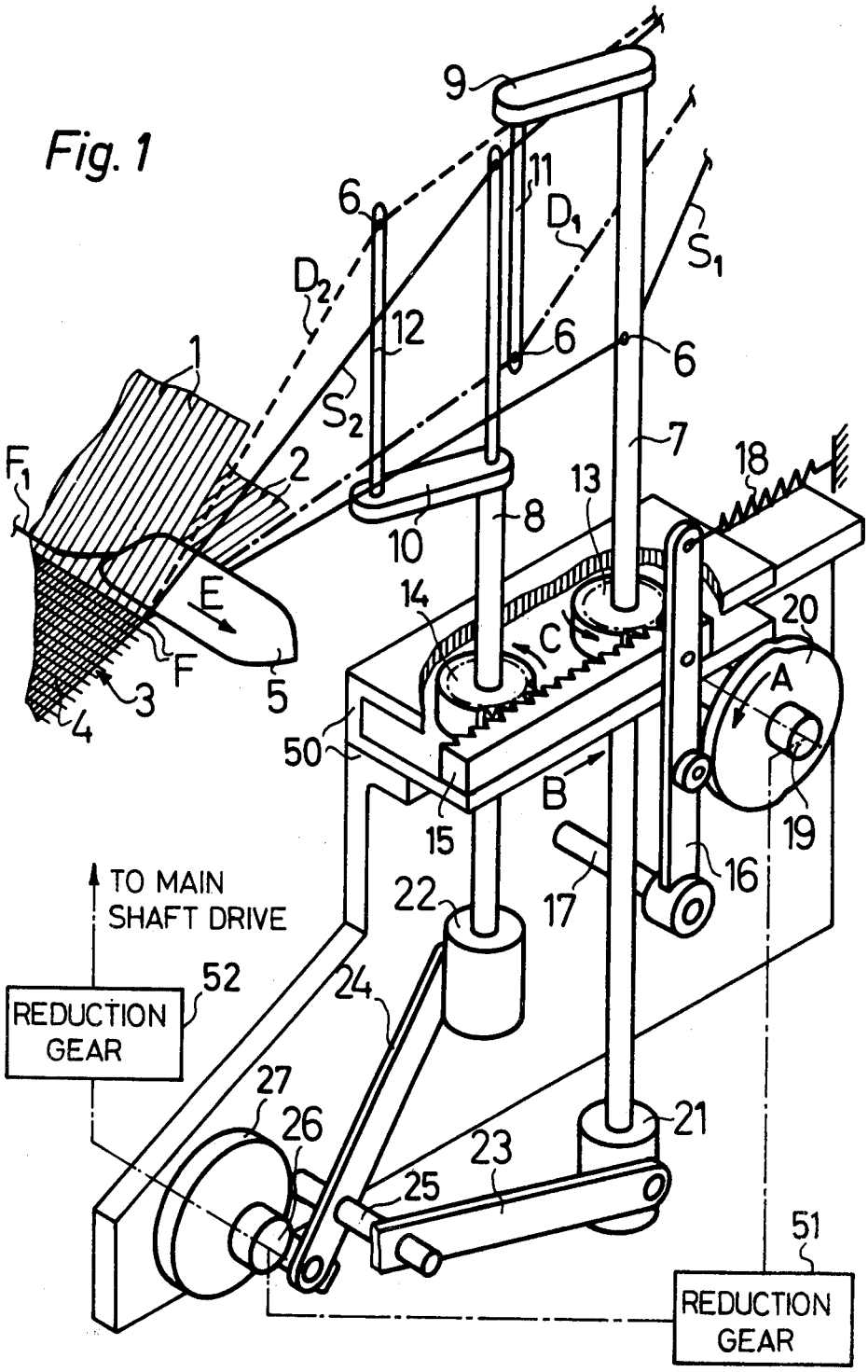
FIG. 1 is a diagrammatic view in perspective showing an apparatus in a travelling wave loom for carrying out the present invention.
Figure 2:
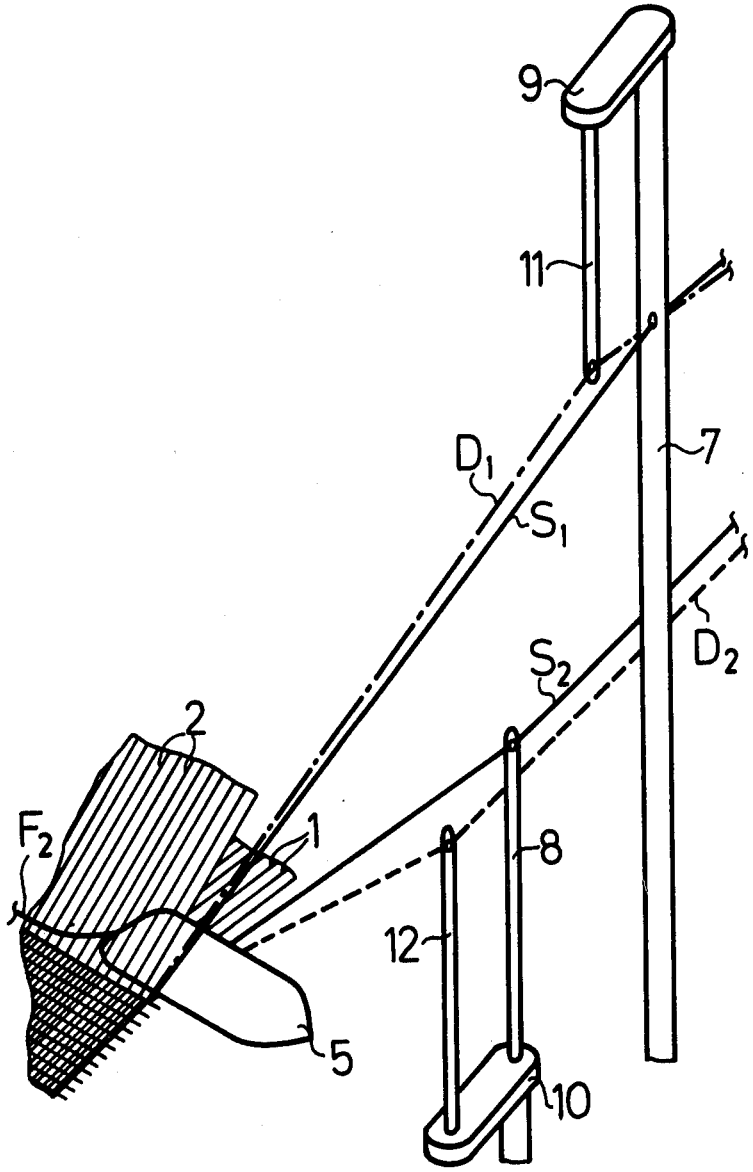
FIGS. 2 through 4 each shows a fragmentary view from the apparatus shown in FIG. 1 in various operating positions during the formation of a selvedge.

FIGS. *6a* and *6b* each shows a diagrammatic plan view of a variant of the thread arrangement shown in the apparatus of FIG. 1 with two different swung positions of the crossing threads; and FIGS. *7a* and *7b* show a variant of the thread arrangement which is shown in FIGS. *6a* and *6b*.

DESCRIPTION OF PREFERRED EMBODIMENTS

In reference to the drawings, in FIG. 1 there is shown warp threads 1 and 2 which are taken-in in a travelling wave loom, and also the fabric 4 formed of the warp threads 1 and 2 and the weft threads F in the region of the right-hand fabric selvedge 3. Since the travelling wave loom is well known in the art, it is symbolized simply by its shuttle 5. An arrow E designates the direction in which the shuttle 5 is conveyed when the weft is inserted.

Connected with the warp threads 1 and 2 are four selvedge threads, two crossing threads $D_1$ and $D_2$ and two noncrossing threads $S_1$ and $S_2$ which are guided by eyelets 6 of a selvedge forming apparatus. The selvedge forming apparatus comprises substantially two approximately vertically directed first rods 7 and 8 which can be displaced in their longitudinal direction and rotated about their longitudinal axis, and second rods 11 and 12 which are connected with the first rods 7 and 8 by arms 9 and 10, respectively. The first rods 7 and 8, which are several times longer than the second rods 11 and 12, are mounted to be capable of displacement in the longitudinal direction on a part 50 connected securely to the weaving machine frame.

The rod 7 comprises at its upper end the arm 9 from which the rod 11 extends downwards. In the region of the free end of the rod 11 there is arranged an eyelet 6 for guiding the crossing thread $D_1$. The rod 7 comprises an eyelet 6 for the guiding of the noncrossing thread $S_1$, the spacing between this eyelet and the arm 9 being slightly larger than the spacing between the eyelet 6 on the rod 11 and the arm 9.

In the region of its upper end, over a length which is several millimeters greater than the length of the rod 12, the rod 8 is stepped down approximately to the diameter of the said rod 12 and on this shoulder supports the arm 10. The rod 12 extends upwards from the arm 10 and is provided in the region of its free end with an eyelet 6 for guiding the crossing thread $D_2$. The rod 8 comprises at its upper end an eyelet 6 for guiding the noncrossing thread $S_2$, the spacing between this eyelet and the arm 10 being several millimeters greater than the spacing between the eyelet 6 on the rod 12 and the arm 10.

Toothed wheels 13 and 14 are operationally mounted one on each of the two rods 7 and 8 in such a manner as to be driven in rotation therewith but capable of displacement in the longitudinal direction of the rod. The two toothed wheels 13 and 14 are in engagement with a rack 15, this rack being pivotably connected to a rocking arm 16. The rocking arm 16 is mounted on a pivot 17 and is pressed by the force of a spring 18 against an eccentric disc 20 rotating during operation in the direction of the arrow A. The eccentric disc 20 which is connected securely to a driving shaft 19, comprises substantially two concentric semi-circles having different radii; thus the rocking arm 16 with the rack 15 is swung for a short distance in each case only at the transition zones between the two semi-circles and then remains in position approximately for half a revolution of the eccentric disc 20. In the rotated position of the eccentric disc 20 shown in the illustration, after a quarter of a revolution of the said disc the rack 15 is moved in the direction of the arrow B, whereby the two rods 7 and 8 and therefore the arms 9 and 10 also with the rods 11 and 12 carry out a sudden rotation in the direction of the arrow C.

At their lower end, the two rods 7 and 8 are each provided with a cylinder 21 and 22 on each of which cylinders there is pivotably connected an arm of a two-arm driving lever 23, 24, respectively. The driving levers 23, 24 are mounted so as to be capable of rotating on a shaft 25 and, as is shown at the driving lever 24, pivotably connected at their other arm in each case to an eccentric disc 27 connected securely to a common rotating shaft 26. The shaft 26 is driven at half the rotational speed of the main shaft of the weaving machine. This means that the two pairs of selvedge threads $D_1$, $S_1$ and $D_2$, $S_2$ take up the same position again in each case after a time corresponding to twice the time interval between two successive passages of the shuttle or weft insertion operation. The driving shaft 19 of the eccentric disc 20 is driven at half the rotational speed of the shaft 26, and is preferably connected with the drive of the shaft 26 by way of a suitable reduction gear 51. The drive of the shaft 26 is itself derived from the drive of the main shaft of the weaving machine by way of a suitable reduction gear 52 (see FIG. 1).

The operation of the selvedge forming apparatus will now be explained with reference to FIGS. 1 through 4:

Directly after the temporary condition shown in FIG. 1, the shuttle 5 moves laterally out of the warp threads 1 and 2, which concludes the insertion of the weft thread $F_1$. Shed changing is then carried out for the selvedge threads. The rod 7 and therefore the pair of selvedge threads $D_1$ and $S_1$ also are moved upwards by the driving lever 23, and the rod 8 and therefore the pair of selvedge threads $D_2$ and $S_2$ also are moved downwards by the driving lever 24. When the rod 7 has reached its upper end point of travel and the rod 8 its lower end point, the eccentric disc 20 has turned further through 90° in the direction of the arrow A, and the rocking arm 16 comes into contact with the region of the transition from the relatively large to the relatively small radius of the eccentric disc 20. In this way the two rods 7 and 8 are swung by means of the rocking arm 16, the rack 15 and the toothed wheels 13 and 14 suddenly in the direction of the arrow C, the angle of swing amounting to about 32°.

As a result, the crossing thread $D_1$ is swung over the noncrossing thread $S_1$ at its other side and the crossing thread $D_2$ is swung below the noncrossing thread $S_2$ at the other side thereof. Meanwhile, with the exit of the next shuttle 5 from the warp threads 1 and 2, the insertion of the next warp thread $F_2$ is already almost concluded and the selvedge forming apparatus is in the instantaneous state shown in FIG. 2.

Figure 3:
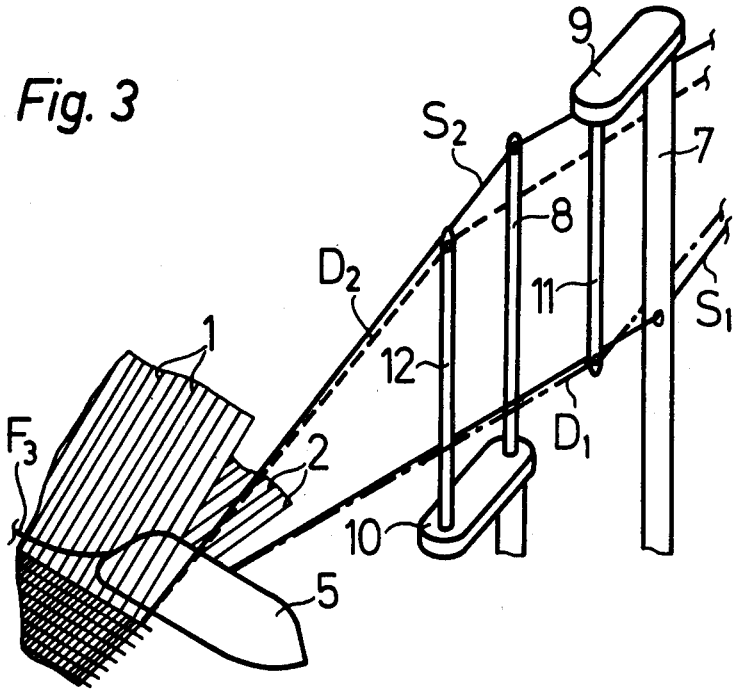

After the insertion of the weft thread $F_2$ there is again shed changing for the selvedge threads. The pair of selvedge threads $D_1$ and $S_1$ is moved downwards and the pair of selvedge threads $D_2$ and $S_2$ upwards. When the selvedge threads $D_1$ and $S_1$ have reached their lower end position and the selvedge threads $D_2$ and $S_2$ their upper end position, the eccentric disc 20 (FIG. 1) has turned further through 90° in the direction of the arrow A (FIG. 1). This instantaneous state, at which the insertion of the next weft thread $F_3$ is almost concluded with the exit of the next shuttle 5 from the warp threads 1 and 2, is shown in FIG. 3.

After the insertion of the weft thread $F_3$ there is again shed changing for the selvedge threads. The pair of selvedge threads $D_1$ and $S_1$ is moved upwards and the pair of selvedge threads $D_2$ and $S_2$ downwards. When the selvedge threads $D_1$ and $S_1$ have reached their upper end of travel position and the selvedge threads $D_2$ and $S_2$ their lower end of travel position, the eccentric disc 20 (FIG. 1) has turned onwards through 90° in the direction of the arrow A. The transition region from the smaller to the larger radius of the eccentric disc 20 now comes into contact with the rocking arm 16 (FIG. 1) and by means of the latter the rack 15 is displaced in the direction opposite to the direction of the arrow B. As a result the two rods 7 and 8 are suddenly swung in the direction opposite to the direction of the arrow C by means of the toothed wheels 13 and 14. The two crossing threads $D_1$ and $D_2$ are again swung back over and below respectively the associated noncrossing threads $S_1$ and $S_2$, and the instantaneous state of affairs shown in FIG. 4 obtains. Meanwhile with the exit of the next shuttle 5 from the warp threads 1 and 2 the insertion of the next weft thread $F_4$ is concluded..

Following the insertion of the weft thread $F_4$ there is again shed changing and the selvedge forming apparatus moves back into the condition shown in FIG. 1.

Figure 5:
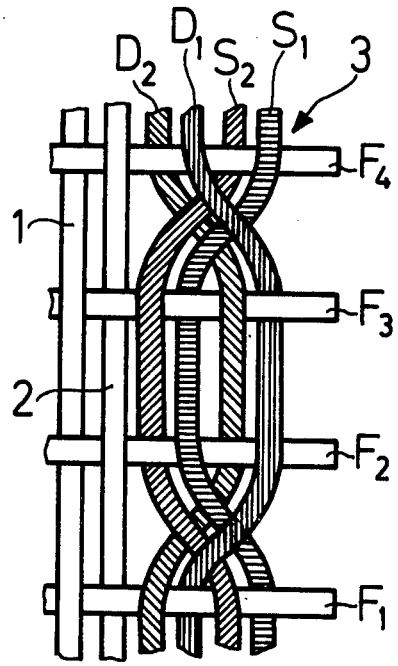
FIG. 5 shows a plan view of a fabric selvedge produced by the invention.
Figure 4:
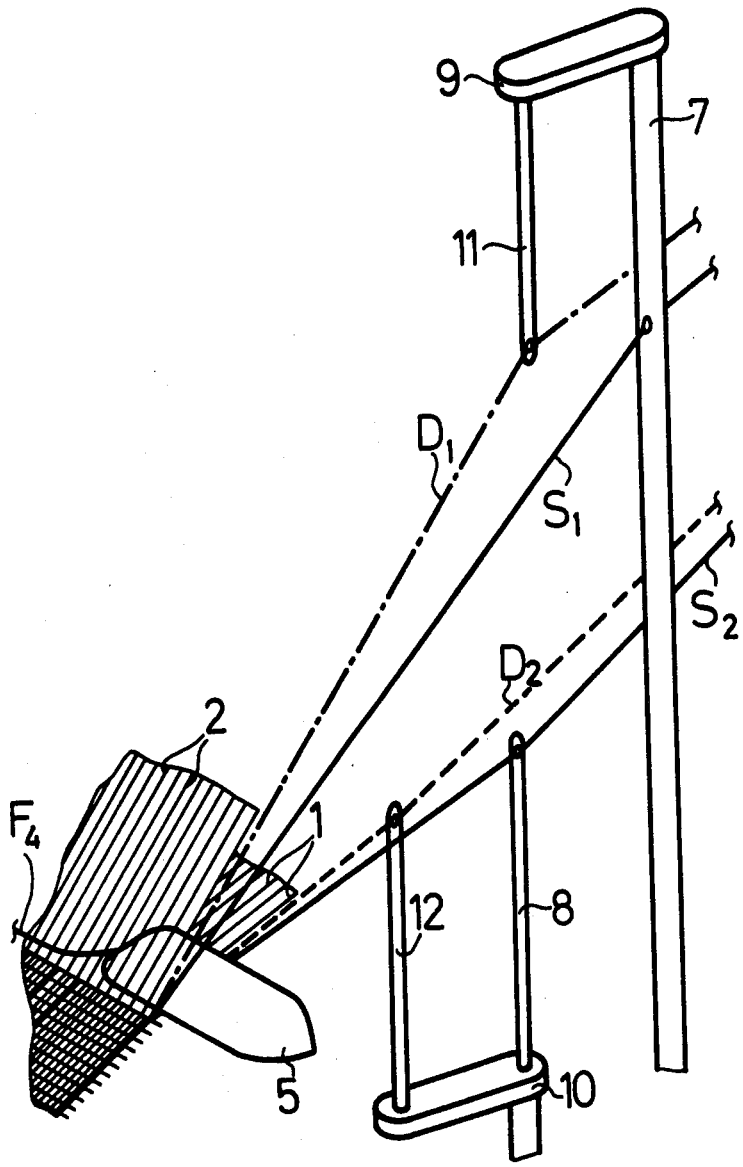

A portion of a leno selvedge 3 formed in the manner described with reference to FIGS. 1 through 4 is shown in FIG. 5, the various selvedge threads being differentiated by different shading. It is to be noted that at the point of intersection between weft thread and selvedge threads, there is always a selvedge thread of one pair of selvedge threads adjacent a thread of the other pair. Thus for example at the intersection with the weft thread $F_3$ there is the following sequence of selvedge threads: right at the outside there is situated the crossing thread $D_1$ of the pair of selvedge threads in the lower shed part and adjacent $D_1$ there is situated the crossing thread $D_2$ of the pair of threads in the upper shed part, and adjacent $D_2$ there is situated the noncrossing thread $S_1$ from the lower shed part and adjacent $S_1$ the noncrossing thread $S_2$ from the upper shed part. At each shed change preceding a swinging movement of the crossing threads, the crossing thread of each pair of selvedge threads is crossed with the noncrossing thread of the other pair of selvedge threads. At shed changing between the insertion of the weft threads $F_1$ and $F_2$, $F_3$ and $F_4$ respectively, $D_1$ is crossed with $S_2$ and $D_2$ with $S_1$. This inter-connection between crossing and noncrossing threads of each pair of selvedge threads on the one hand and between the pairs of selvedge threads on the other hand produces a greater strength of the selvedge 3.

In the description regarding FIG. 1, it was stated that the spacing between the arms 9 and 10 and the eyelets 6 at the rods 7 and 8 is greater than the spacing between the arms 9 and 10 and the eyelets 6 at the rods 11 and 12. Consequently, the crossing thread $D_1$ is always swung above the noncrossing thread $S_1$ and the crossing thread $D_2$ always below the noncrossing thread $S_2$. Of course the selvedge forming apparatus may also be designed so that both crossing threads are swung above or both below their noncrossing threads, or $D_1$ being swung below $S_1$ and $D_2$ above $S_2$.

If, for example, both crossing threads were swung below their noncrossing threads, in FIG. 3 at the points of intersection of the two threads $D_1$ and $S_1$ the crossing thread $D_1$ would always have to be shown below the noncrossing thread $S_1$. It will easily be appreciated that this would not alter the basic principle of the method for forming selvedges and the qualities of the selvedge thus obtained.

FIGS. *6a, 6b* and *7a, 7b* show two constructional forms of the arrangement shown in FIGS. 1 through 4 which are suitable for forming central selvedges. The illustrations each shows a diagrammatic plan view on to the selvedge threads and the arms supporting the rods with the guide eyelets for the selvedge threads, whereby in FIGS. *6a* and *7a* the arms with the selvedge threads are shown in one pivoted position and in FIGS. *6b* and *7b* in the other pivoted position.

According to FIGS. *6a* and *6b* in each case four rods 30, 31, 32, 33 and 34, 35, 36, 37 each carrying an eyelet for guiding a selvedge thread are mounted on a common supporting arm 28 and 29 respectively. The two arms 28 and 29 each comprises a long portion from the ends of which a shorter portion extends in each case. At the supporting arm 29 the short portions are of equal length and the angle between these and the long portion amounts to 90° in each case. At the supporting arm 28 the short portions are of different length and the angle between one short portion and the long portion amounts to 84° and the angle between the other short portion and the long portion amounts to 90°.

The two supporting arms 28 and 29 are adapted to pivot about an axis which is situated in prolongation of the rods 31 and 35 and extends perpendicularly to the drawing plane. Of the four rods 30–33 and 34–37 arranged on each supporting arm, two of them in each case guide selvedge threads to each of the central selvedges M and M'. From the rods 31 and 35 in alignment with the pivoting axes of the supporting arms, a noncrossing thread in each case $S_2'$ and $S_1'$ respectively leads to the central selvedge M' and of the rods 30 and 34 secured on the short portions of the supporting arms 28 and 29 adjacent the pivoting axes a noncrossing thread $S_1$ and $S_2$ respectively leads to the central selvedge M. The rods 30 and 24 are in fact pivoted at the swinging movement of the supporting arms 28 and 29, but this pivoting movement is very small, as a comparison of the two illustrations FIGS. *6a* and *6b* shows, so that the selvedge threads $S_1$ and $S_2$ can justifiably be called noncrossing threads. From the rods 32 and 36 of the two supporting arms 28 and 29 a crossing thread $D_2'$ $D_1'$ respectively leads to the central selvedge M' and from the rods 33 and 34 a crossing thread $D_1$ and $D_2$ respectively leads to the central selvedge M.

Selvedge forming with the apparatus shown in FIGS. *6a* and *6b* is carried out in a similar manner to the apparatus shown in FIGS. 1 through 4, and the selvedge shown in FIG. 5 is also formed as a result.

In the constructional example which is shown in FIGS. *7a* and *7b* there are again in each case four rods 40, 41, 42, 43 and 44, 45, 46, 47 each comprising an eyelet for guiding a selvedge thread, mounted on a common supporting arm 38 and 39 respectively. The supporting arms 38 and 39 are of similar shape to those shown in FIGS. *6a* and *6b* but with the important difference that their axes of pivoting movement 48 and 49 respectively are not in alignment with one of the rods but are situated approximately in the middle of the long portion of the supporting arm. As a result when there is a swinging movement of the supporting arms 38 and 39, all the border threads are always swung, in other words there are then only crossing threads and no longer any noncrossing threads for forming the selvedge.

As shown, from the rods 40 and 44 a crossing thread $D_4$ and $D_3$ respectively and from the rods 43 and 47 a crossing thread $D_2$ and $D_1$ respectively leads to the central selvedge M. From the rods 41 and 45 a crossing thread $D_4'$ and $D_3'$ and from the rods 42 and 46 a crossing thread in each case $D_2'$ and $D_1'$ leads to the central selvedge M'.

Figure 6A:
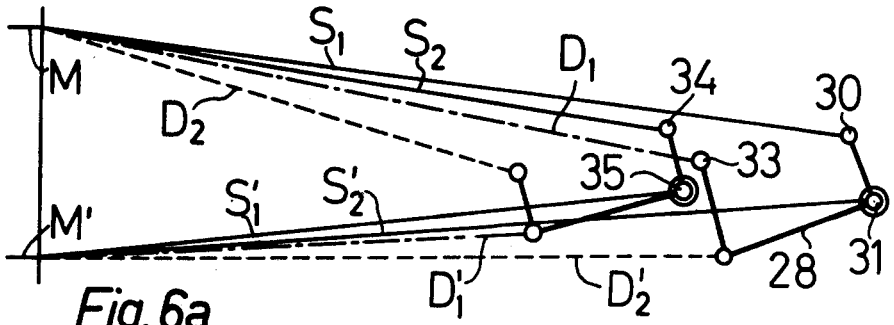
Figure 6B:
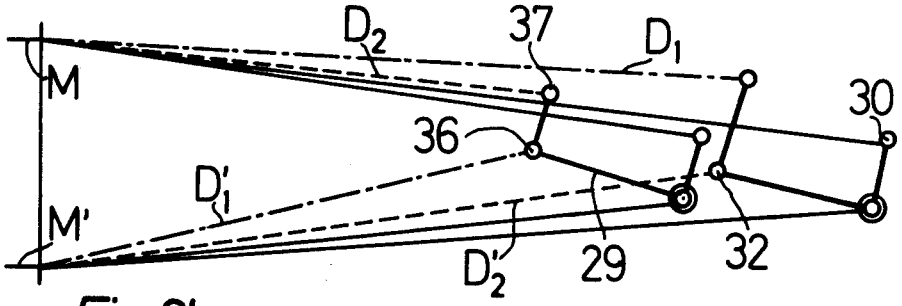
Figure 7A:
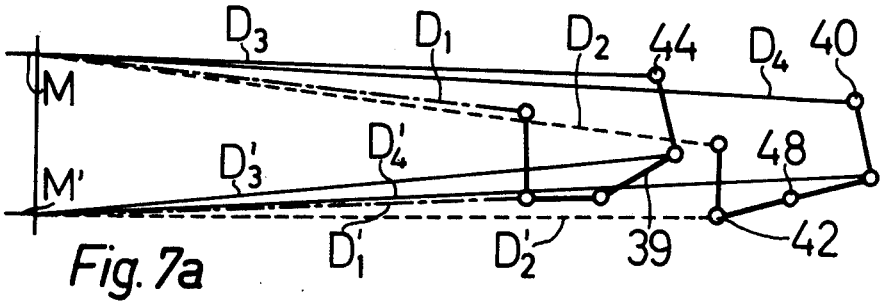
Figure 7B:
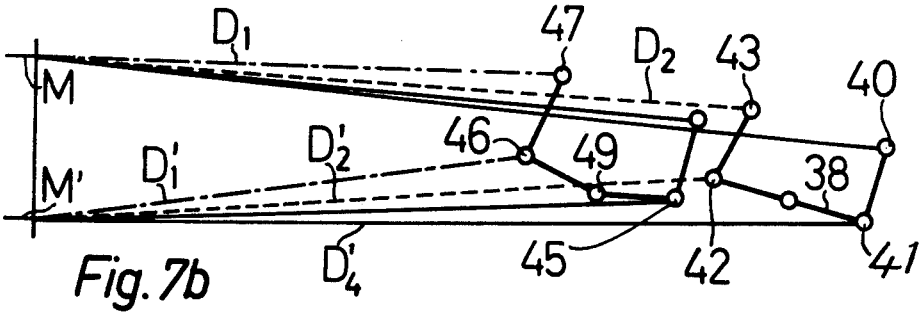

If FIGS. *7a, 7b* are compared with FIGS. 6a, 6b, it will be seen that the crossing threads $D_3$, $D_4$ and $D_3'$ $D_4'$ coincide as regards function with the noncrossing threads $S_1$, $S_2$ and $S_1'$, $S_2'$ respectively. Thus even when using the apparatus shown in diagrammatic manner in FIGS. *7a* and *7b* the selvedge shown in FIG. 5 is obtained.

FIGS. *6a, 6b* and *7a, 7b* show that in the foregoing description when certain threads have been referred to as noncrossing threads, this is not to be understood as implying that these threads do not carry out a swinging movement. On the contrary, these threads may be swung to a more or less considerable extent without modifying anything the method described. For if a first thread is swung from its starting position at one side of a second thread to the other side of the said second thread and later back into its initial position, it is substantially immaterial whether the second thread remains stationary or is moved also.

In the foregoing description the selvedge forming apparatus has been described in connection with a travelling wave loom. This should not be understood as implying any limitation. On the contrary, the apparatus described can be used in any kind of weaving machine where a leno selvedge is to be formed either in the middle or at the edge of the fabric. What was said in the description regarding FIG. 1 is true in all cases of the driving of the shaft 26 and the driving shaft 19 (FIG. 1).

It will be appreciated that various changes and/or modifications may be made within the skill of the art without departing from the spirit and scope of the invention illustrated, described, and claimed herein.

What is claimed is:

1. A method of forming a fabric selvedge on a loom with two crossing threads and two noncrossing threads in each case, characterized in that a crossing thread and a noncrossing thread in each case, threads $D_1$, $S_1$, and threads $D_2$, $S_2$, are associated with one another as a pair of selvedge threads and are guided in eyelets situated substantially adjacent one another, and that the selvedge is formed by cyclic repeating of the following steps:

(a) producing a shed forming movement of the one pair of selvedge threads in one direction and the other pair of selvedge threads in the other direction, subsequently pivoting each crossing thread from one side of its associated noncrossing thread to the other side and inserting a weft thread, and (b) producing a shed forming movement of the one pair of selvedge threads in the other direction and the other pair of selvedge threads in the one direction and subsequently inserting a weft thread; the crossing threads so guided and pivoted that at each shed forming movement following the pivoting of the crossing threads, the crossing thread of each pair of selvedge threads is crossed over with the noncrossing thread of the other pair of selvedge threads.

2. The method according to claim 1 in which during the pivoting movement of the crossing threads $D_1$, $D_2$, the noncrossing threads $S_1$, $S_2$ are moved pivotably in the opposite direction to the said crossing threads.

3. The method according to claim 1 in which one crossing thread $D_1$ is moved pivotably in a plane above its associated noncrossing thread $S_1$ and the other crossing thread $D_2$ in a plane below its associated noncrossing thread $S_2$.

4. An apparatus for forming a fabric selvedge on a loom with two crossing threads and two noncrossing threads, having guide eyelets for associating a crossing thread and a noncrossing thread in each case, threads $D_1$, $S_1$, and threads $D_2$, $S_2$, with one another as a pair of selvedge threads, said guide eyelets for each pair of selvedge threads being situated substantially adjacent one another, and having holding means for the guide eyelets of the crossing and noncrossing threads and with first and second driving means coupled with these holding means, the first driving means being provided for the shed forming movements of all the holding means and the second driving means for the pivoting movement of the holding means, comprising the guide eyelets of the crossing threads, characterized in that the first driving means and the second driving means are so controlled that the pivoting movement of the holding means for the guide eyelets of the crossing threads $D_1$, $D_2$ is carried out in each case after each second shed forming movement.

5. The apparatus according to claim 4 in which the holding means for the guide eyelets of the crossing threads $D_1$, $D_2$ and noncrossing threads $S_1$, $S_2$ are formed of rods which are directed at an inclination to the warp threads and parallel to one another, and two of the rods with the guide eyelets in each one for a pair of selvedge threads in each case are connected securely to one another by means of a supporting arm and in each case one of the two inter-connected rods is longer than the other and is connected at one end to the first driving means.

6. The apparatus according to claim 5 in which, during operation, each supporting arm swings to-and-fro through an angle of between 15° and 45°.

7. The apparatus according to claim 5 in which, during operation, each supporting arm swings to-and-fro through an angle of about 32°.

8. The apparatus according to claim 5 in which the rods that comprise the said guide eyelets for the noncrossing threads $S_1$, $S_2$ in each case are connected to the first driving means.

9. The apparatus according to claim 8 in which the rods and the supporting arms connecting them together in pairs are so constructed that in one pair of rods the supporting arm connects together the upper ends of the rods and the rods project downwards from the supporting arm, and in the other pair of rods the supporting arm is secured at the rod connected to the first driving means at a spacing from the upper end corresponding to the length of the other rod of this pair, and supports the lower end of the other rod of this pair, so that the last-mentioned rod and also a part of the rod of this pair connected to the first driving means project upwards from the supporting arm.

10. The apparatus according to claim 9 in which the guide eyelets for the selvedge threads are arranged one in each rod at a distance from the respective supporting arm which corresponds approximately to the length of the shorter rod of each pair.

11. The apparatus according to claim 10 in which the first driving means is formed of two arm levers pivotable about a common shaft and pivotably connected at one end to the respective rods of each of said pair and the other end of the said levers being each operatively connected to a first eccentric disc.

12. The apparatus according to claim 11 in which each of the rods connected to the first driving means is operatively mounted to be rotatable and capable of displacement on a fixed weaving machine part at that portion of the said rod which projects in length beyond the rod connected to it, and is guided to be capable of longitudinal displacement through toothed wheels, these toothed wheels being coupled with their rods for integral rotational movement, and engaging with a rack to which rack there is pivotably connected to rocking lever controlled by a second eccentric disc.

13. The apparatus according to claim 12 in which the periphery of the second eccentric disc is formed of two semicircles having different radii, and this eccentric disc during operation is driven at half the rotational speed of the first eccentric disc which controls the said two levers of the first driving means.

14. The apparatus according to claim 10 in which each of the rods connected to the first driving means is operatively mounted to be rotatable and capable of displacement on a fixed weaving machine part at that portion of the said rod which projects in length beyond the rod connected to it, and is guided to be capable of longitudinal displacement through toothed wheels, these toothed wheels being coupled with their rods for integral rotational movement, and engaging with a rack to which rack there is pivotably connected a rocking lever controlled by a second eccentric disc.

15. The apparatus according to claim 14 in which the periphery of the second eccentric disc is formed of two semicircles having different radii, and this eccentric disc during operation is driven at half the rotational speed of the first eccentric disc which controls the said two levers of the first driving means.

* * * * *